United States Patent [19]

Smith, Jr. et al.

[11] 4,126,757

[45] Nov. 21, 1978

[54] MULTIZONE GRAPHITE HEATING ELEMENT FURNACE

[75] Inventors: Charles W. Smith, Jr., Fairview; Franz X. Zimmerman, Erie, both of Pa.

[73] Assignee: Autoclave Engineers, Inc., Erie, Pa.

[21] Appl. No.: 872,095

[22] Filed: Jan. 25, 1978

[51] Int. Cl.[2] ..... F27B 5/14; F27D 11/02; H05B 3/06

[52] U.S. Cl. ..... 13/25; 13/22; 219/406

[58] Field of Search ..... 13/20, 22, 25; 219/406, 219/408, 390, 546

[56] References Cited

U.S. PATENT DOCUMENTS

| | | | |
|---|---|---|---|
| 3,004,090 | 10/1961 | Donovan et al. | 13/25 |
| 3,150,226 | 9/1964 | Thorne et al. | 13/25 |
| 3,395,241 | 7/1968 | Roman | 13/25 |

*Primary Examiner*—R. N. Envall, Jr.

*Attorney, Agent, or Firm*—Webb, Burden, Robinson & Webb

[57] ABSTRACT

This invention relates to an electric furnace and, in particular an electric furnace having graphite rod heating elements electrically connected into more than one series circuit. In this way, the heating elements can be arranged to provide individually controllable heating zones.

4 Claims, 4 Drawing Figures

MULTIZONE GRAPHITE HEATING ELEMENT FURNACE

Electrical resistance furnaces, i.e., furnaces heated with resistance heating elements are well known and have been made with numerous types of heating elements. Refractory metal resistance elements are very common. The metal resistance elements are suitable to be arranged in numerous electrical configurations and have commonly been arranged to provide multizone heating in which the electrical currents in spaced portions of the heating element are individually controllable to provide a desired temperature distribution (uniform or gradient).

More specifically, this invention relates to autoclave furnaces wherein the workpiece may be simultaneously treated at elevated temperatures and pressures. While in some instances convection currents of the gaseous pressure medium will promote temperature uniformity within the autoclave furnace, there exist applications where initial heat-up of the workpiece is not under high pressure and heating principally by radiation is required. In these instances, only a multizone furnace with individually controllable heating elements can provide a sufficiently uniform temperature throughout the workspace. An example of such an application is hot isostatic pressing of silicon nitride in glass jackets. The prepressed and machined silicon nitride shapes are placed in glass containers which are evacuated and sealed. The glass containers with the unsintered shapes therein are placed in an autoclave furnace and heated under low pressure (near atmospheric pressure) until the glass is plastic, say at 1300° C., after which the glass and shapes are heated under pressures up to about 15,000 psi at temperatures of about 1700° to 1900° C. The glass container collapses against the silicon nitride shape and forms an impermeable jacket. Therefore, the pressure within the vessel is isostatically applied through the jacket to the shape.

It is known that there exists a temperature above which refractory metal heating elements cannot, practically speaking, be used. Above 1650° C. only molybdenum, tungsten and graphite heating elements are even candidates and then only in a vacuum or protective atmosphere. The maximum temperature of use for these metals and for graphite are usually given as follows:

| | Maximum Resistor Temperature |
|---|---|
| Molybdenum | 1870° C |
| Tungsten | 2040° C |
| Graphite | 2700° C |

Actually, these maximum temperatures do not consider the problems of supporting the molybdenum and tungsten heating elements and their leads which have a great tendency to creep under their own weight at relatively high temperatures. Graphite, in addition to being more refractory is about one-fifth as dense as the metals. Hence, graphite does not have the same tendency to creep at elevated temperatures and is the leading candidate for very high temperature heating elements.

Nevertheless, graphite has not been commonly used, if at all, for very high temperature furnaces electrically connected into individual series circuits for multizone temperature control. Graphite heating elements are rigid. This being the case, they cannot be emplaced as in the case of coiled refractory wire heating elements. Each section of graphite rod used as a heating element must have a fitting at each end thereof for connecting the rods the remainder of the electrical circuit in which it is placed. At least one end of each rod must be free to accommodate thermal expansion. (Examples of prior art furnaces with graphite rod heating elements are U.S. Pat. Nos. 3,150,226 and 3,395,241.) Because of the fitting problem, electrical resistance furnaces with graphite rod heating elements are not easily adapted to multizone furnaces. It is difficult to provide individually controlled series circuits comprised of graphite rods arranged in proximity to a given zone. Hence, prior multizone furnaces of the type disclosed herein have not used graphite rod heating elements.

It is an advantage according to this invention to provide a multizone furnace having graphite rod heating elements which may be safely heated to temperatures in excess of 1600° C. The furnace according to this invention is particularly adaptable to hot isostatic pressing in which the furnace is enclosed in a high pressure autoclave vessel.

Briefly according to this invention there is provided a multizone furnace having carbon or graphite rod heating elements. A plurality of hollow graphite cylinders having a common, generally vertical axis are axially aligned. A plurality of annular graphite rings having upper and lower seats for engaging the edges of the graphite cylinders are placed between the hollow graphite cylinders and one ring is placed upon the top edge of the uppermost graphite cylinder. The cylinders and rings are arranged and sized such that the rings extend radially inward of the inner wall of the cylinders forming a horizontal flange. The flanges are provided with a plurality of circumferentially spaced holes. Electrically non-conductive tubular refractory spacers are positioned in each of said holes and extend above the top of the flange surface. Graphite heating rods are passed through the tubular spacers and suspended from the flange. The rods are joined by connector blocks into a series circuit. The length of the heating element, hung from any given flange with the exception of lead rods, is less than the axial length of graphite cylinders from which the ring is supported. Each series circuit of graphite heating rods defines an axial, separately controllable heating zone. According to a preferred embodiment of this invention, the tubular spacers are comprised of boron nitride.

Further features and other objects and advantages of this invention will become apparent from the following detailed description made with reference to the drawings in which FIG. 1 is a section through an autoclave furnace according to this invention;

Figure 1:
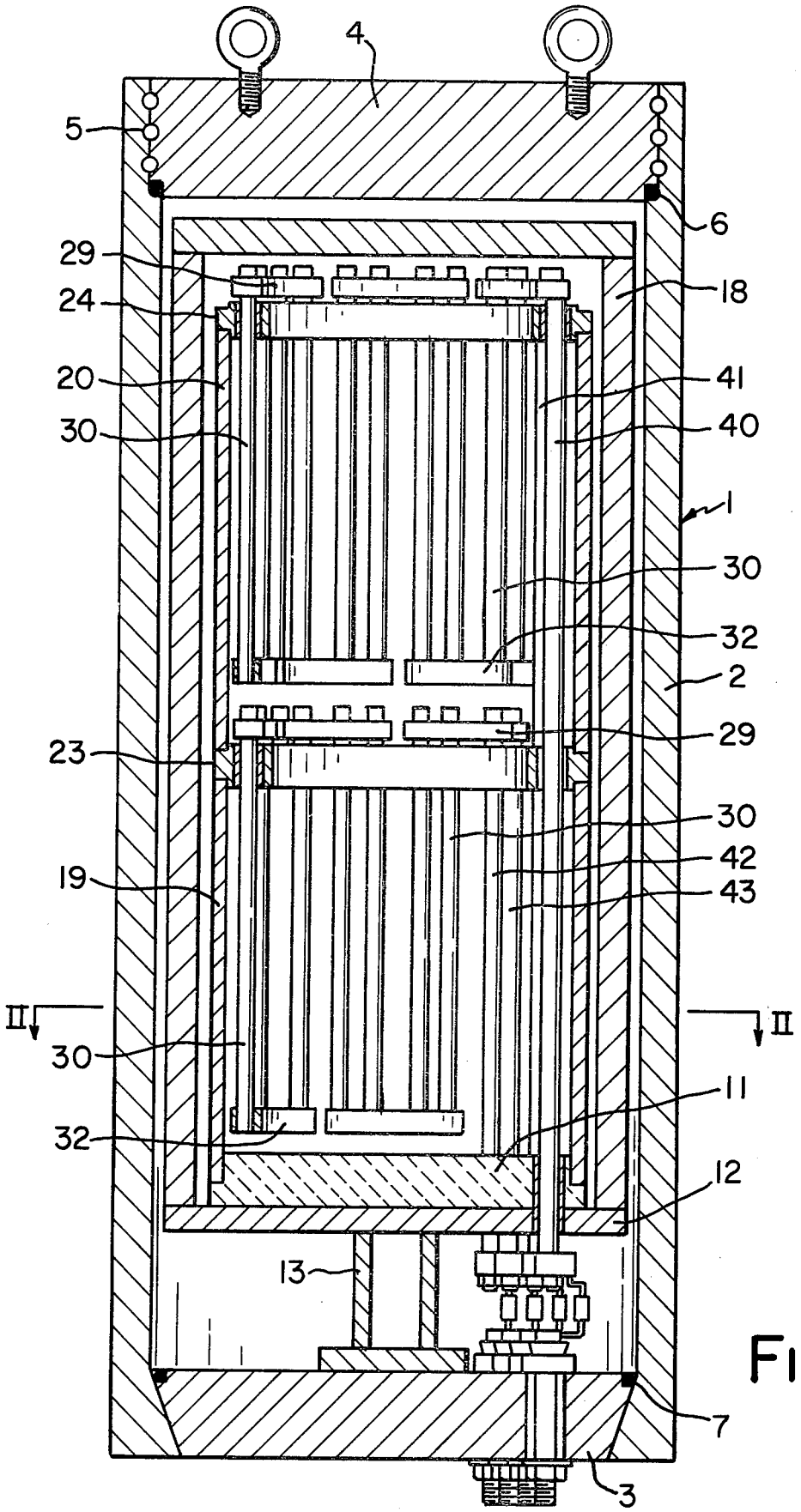

Referring now to FIG. 1, there is shown an autoclave furnace according to this invention. The pressure vessel 1 comprises a cylindrical section 2, bottom 3 and removable top cover 4. The top is secured by a coiled spring worked into the helical groove 5 defined by both the cylindrical section and the cover. Upper 6 and lower 7 seals make the vessel pressure tight.

Pressurizing connections and power and thermocouple feedthroughs pass through the bottom 3 of the pressure vessel (not shown in drawing).

Figure 3:
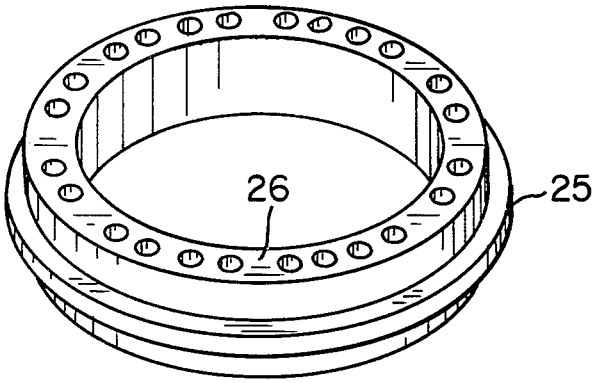
FIG. 3 is a perspective view of a graphite ring useful as an element in the practice of this invention.
Figure 2:
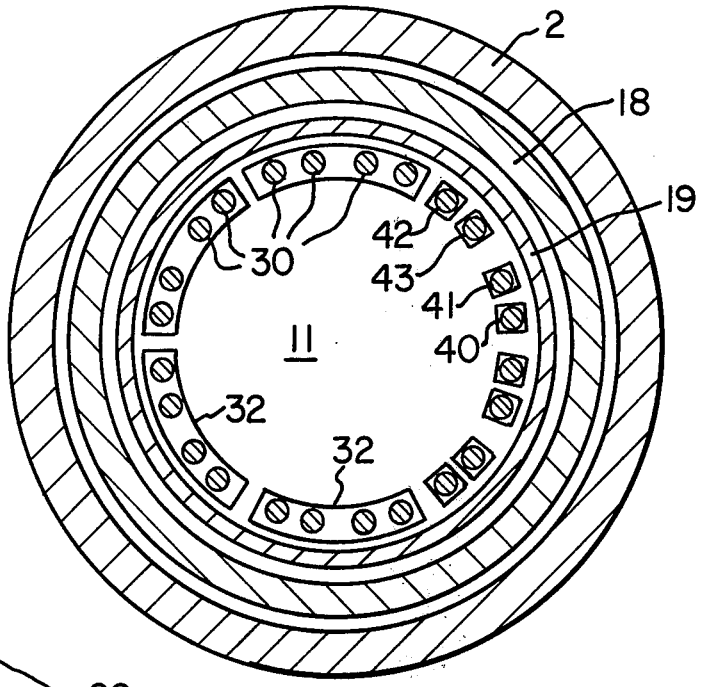
FIG. 2 is a plan view in section along line II—II in FIG. 1 of an autoclave furnace according to this invention.

Within the pressure vessel is a furnace. The furnace has a refractory hearth 11 set upon a bottom 12 supported above the vessel by a foot 13. A heat insulating hood 18 comprised of refractory material such as high alumina fireclay brick is backed up by insulating refractory castable. The hood sets upon the bottom 12. Within the hood and anchored on the bottom is an inner reflective liner comprising hollow graphite cylinders 19 and 20 axially spaced apart by a graphite ring 23. A similar or identical ring 24 rests upon the top of cylinder 20. The structure of the rings 23 and 24 are shown with more detail in FIG. 3. An outer rim 25 is arranged and sized to fit between the spaced graphite cylinders or to rest on the top thereof. The interior portion 26 of the ring is arranged and sized to fit within the inner wall of the graphite cylinders with which they are associated. The inner portion comprises a horizontal flange and has a plurality of openings therethrough with axes parallel to the axis of the ring.

Figure 4:
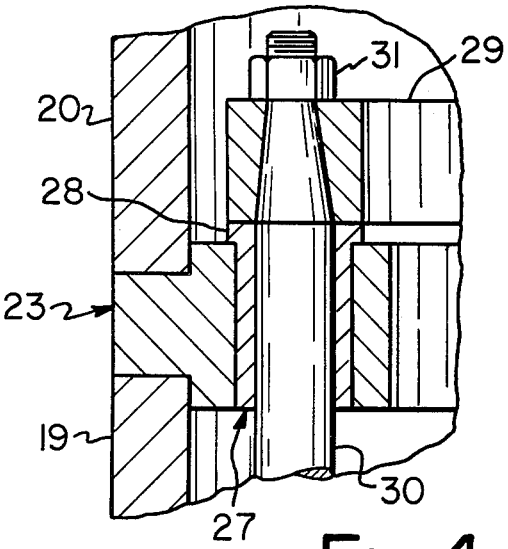
FIG. 4 is a partial view in section of the details of the holes passing through the rings shown in FIG. 3 and their relationship to the graphite rod heating elements.

FIG. 4 illustrates in more detail the holes through the graphite ring 23. A tubular spacer 27 fits into each hole and has an upper rim 28 which prevents the sleeve from falling through the hole and spaces the upper end of the spacer away from the surface of the graphite ring. Hence, a graphite connector block 29 set upon the spacer is held away from the graphite ring. The tubular spacer may be made of high purity alumina for temperatures up to about 1700° C. Beyond that temperature, it is difficult to find a suitable oxide material for the spacers. Zirconia, even though very refractory, cannot be used as it becomes electrically conductive. Thorium oxide presents a radioactivity problem. The preferred composition is boron nitride which has more than adequate refractoriness and sufficient resistance to reaction with graphite at temperatures around 1900° C.

The graphite heating elements 30 are threaded at their lower end and are threadably connected to the lower graphite connecting blocks 32. The heating elements pass up through the graphite rings 23 and 24 and into conical or tapered openings in the upper connector blocks 29. A mating surface at the top of the rings snugly fits the interior surface of the blocks. A threaded portion of the rod extends through the upper block and is secured by a graphite nut. Thus the graphite heating elements are hung from graphite rings supported by hollow graphite cylinders. The heating elements are electrically insulated from the cylinders and rings, thus permitting individually controllable electrical circuits and thus individually controllable heating zones.

In the particular embodiment shown, the heating rods hung from the upper ring are arranged in one series circuit in which each rod is in parallel (electrically speaking) with one adjacent rod and in series with all others. This circuit powers the upper heating zone which is generally within the axial length of the upper hollow graphite cylinder 20. The leads to the upper zone, two of which 40 and 41 are shown in FIG. 1, pass up through the lower zone. A total of four leads pass through the lower zone to power the upper zone. Each lead rod is electrically parallel with one other lead rod. The lead rods for the upper zone are heating elements for both the upper and lower zones.

Heating rods or elements hung from the lower ring are arranged in one series circuit in a manner similar to that described for the upper zone. Four lead rods, two of which 42 and 43 are shown in FIG. 1, supply current to the series circuit defined by the heating rods and connecting blocks in the lower zone.

All the graphite rods, whether heating or lead rods, are hung from just one end and are, therefore, free to expand and contract relative to the furnace support without developing compressive stresses.

For simplicity, the furnace described herein has two zones. More than two zones are within the comtemplation of this invention.

In the preferred embodiment described herein, the holes in the horizontal flange of the rings are circular cylindrical and the spacers are tubular. However, this invention contemplates differently spaced holes and spacers. For example, instead of circular cylindrical holes, radial slots extending radially outward of the inner cylindrical surfaces of the horizontal flanges could be provided. Then, the spacers would be designed with a generally U-shaped cross section and to slide into the slots with their open edge facing radially inward. In this embodiment, a broken rod could more easily be replaced as it would not be necessary to slide the rod up and down in the axial direction to position it with the holes of the ring from which it is suspended.

Having thus defined my invention in the detail and particularity required by the Patent Laws, what is desired protected by Letters Patent is set forth in the following claims.

I claim

1. A multizone furnace having carbon or graphite rod heating elements comprising a plurality of hollow graphite cylinders having a common generally vertical axis, a plurality of annular graphite rings having upper and lower seats for engaging the edges of the cylinders, said cylinders and rings arranged such that a ring is positioned between each adjacent cylinder and a ring rests upon the top of the uppermost cylinder, said rings extending radially inward of the inner wall of said cylinders forming a horizontal flange, said flanges having a plurality of circumferentially spaced openings therein, electrically non-conductive spacers positioned in said openings and extending above said ring surface, graphite heating elements passing through said spacers and being hung from said horizontal flanges, said elements suspended from each horizontal flange being joined by connecting blocks to form a series circuit, whereby each series circuit associated with one horizontal flange powers a separately controllable heating zone.

2. A furnace according to claim 1 wherein the tubular spacers are comprised of boron nitride.

3. A furnace according to claim 1 wherein the leads for any series circuit associated with one horizontal flange are carbon or graphite rods being hung from that horizontal flange and extending downwardly through the horizontal flanges, in any, positioned therebelow.

4. A furnace according to claim 1, wherein the openings in the horizontal flanges are cylindrical with an axis parallel to the axis of the ring and the spacers are tubular with an annular rim on the outer surface thereof.

* * * * *